United States Patent [19]

Gardner et al.

[11] Patent Number: 4,516,618

[45] Date of Patent: May 14, 1985

[54] EDGE SEAL AND RERAILER FOR INSULATING SHADE

[75] Inventors: Bruce C. Gardner, Brattleboro; Daniel L. Ingold, Wardsboro, both of Vt.; David A. May, Brookline, Mass.

[73] Assignee: Appropriate Technology Corporation, Brattleboro, Vt.

[21] Appl. No.: 406,064

[22] Filed: Aug. 6, 1982

[51] Int. Cl.[3] ..... E06B 1/34; E06B 3/28

[52] U.S. Cl. ..... 160/120; 160/266

[58] Field of Search ..... 160/120, 266–274, 160/121, 23–26; 16/87.8 R, 97 R; 2/222, 232, 47

[56] References Cited

U.S. PATENT DOCUMENTS

| | | | |
|---|---|---|---|
| 486,433 | 11/1892 | Cochran | 160/270 X |
| 955,687 | 4/1910 | Rawson | 2/222 |
| 4,039,019 | 8/1977 | Hopper | 160/121 R |
| 4,220,189 | 9/1980 | Marquez | 160/269 |
| 4,258,517 | 3/1981 | Hammond | 160/269 |
| 4,408,650 | 10/1983 | Verch | 160/272 X |

FOREIGN PATENT DOCUMENTS

| | | | |
|---|---|---|---|
| 1569966 | 6/1969 | France | 160/266 |
| 681602 | of 1965 | Italy | 160/266 |
| 1021967 | 3/1966 | United Kingdom | 160/271 |

*Primary Examiner*—Peter M. Caun
*Assistant Examiner*—Cherney S. Lieberman
*Attorney, Agent, or Firm*—Wolf, Greenfield & Sacks

[57] ABSTRACT

An insulating window shade assembly includes a shade frame having a pair of vertical side channels open in a direction facing one another and designed to be mounted on the inside of the window to be insulated. A flexible insulating shade having inner and outer spaced apart parallel panels extends downwardly from the top of the channels, and the margins of the panels extend into the channels. Edge seals are provided in each channel made up of a pair of flexible polyester film strips with the adjacent sides of the strips being spring biased towards one another but being separable so that the margins of the shade panels may lie between them. The flexible character of the strips forms an effective insulating seal about the margins. A rerailer assembly is provided at the tops of the edge seals to guide the margins of the each panel between the strips of the edge seal should they become dislodged.

13 Claims, 14 Drawing Figures

EDGE SEAL AND RERAILER FOR INSULATING SHADE

INTRODUCTION

This invention relates to window coverings and more particularly comprises an insulating shade assembly having improved edge seals for the shade and a rerailer to ensure registration of the margins of the shade with the edge seals.

In copending application Ser. No. 339,334 filed Jan. 15, 1982 entitled "Insulating Window Covering" assigned to the assignee of the present application, an insulating shade assembly is shown wherein the shade is provided with a double roller support so as to cause the shade to define two separate panels separated by an air space to maximize the insulating properties of the shade. The margins of the shade are captured within facing U-shaped channels on the window frame. The object of the present invention is to provide a new and improved edge seal for the shade panels and a rerailer for ensuring that the margins of the shade panels are engaged by the edge seal.

In designing an edge seal, not only must it be effective functionally, but it must be aesthetically appealing and reasonably priced as well. Accordingly, another important object of the present invention is to provide an edge seal which fits wholly within the side channels of the shade frame so as to be at least partially hidden from view by the channels and which is unobtrusive.

Yet another important object of this invention is to provide an edge seal which can be inexpensively manufactured and which may very easily be installed at the site.

Another important object of this invention is to provide a rerailer which forms part of the edge seal and which effectively and dependably will guide the margins of the panels of the shade into the edge seals when they become dislodged.

SUMMARY OF THE INVENTION

The shade assembly of the present invention includes U-shaped channels forming part of the shade frame, which are open in a direction facing one another and which receive the margins of the shade panels. Disposed within each of the channels on the sides of the assembly are outer and inner generally U-shaped flexible polyester sheets that are parallel to one another, and the centers of the sheets are secured together while the margins of the sheets which engage one another may be separated to receive the edges of the panels. The sheets are flexible but possess sufficient springiness to cause the inner sheet to bear against the edge or margin of the shade panels and in turn push the margin against the facing surface of the outer sheet so that a tight sandwich is formed about the shade margin.

Slots are formed adjacent the bottoms at the side edges of each panel of the shade which slots are designed to span inwardly directing guides at the tops of the edge seals so that when the shades are fully raised and then lowered, the guides enter the slots and pick up the edges of the panels and direct them between the sheets of the edge seal. If the edges of the shade are somehow dislodged from between the sheets of the edge seal, the shade need only be raised to the top and then lowered to reintroduce the edges into the edge seals.

BRIEF FIGURE DESCRIPTION

DETAILED DESCRIPTION

Figure 1:
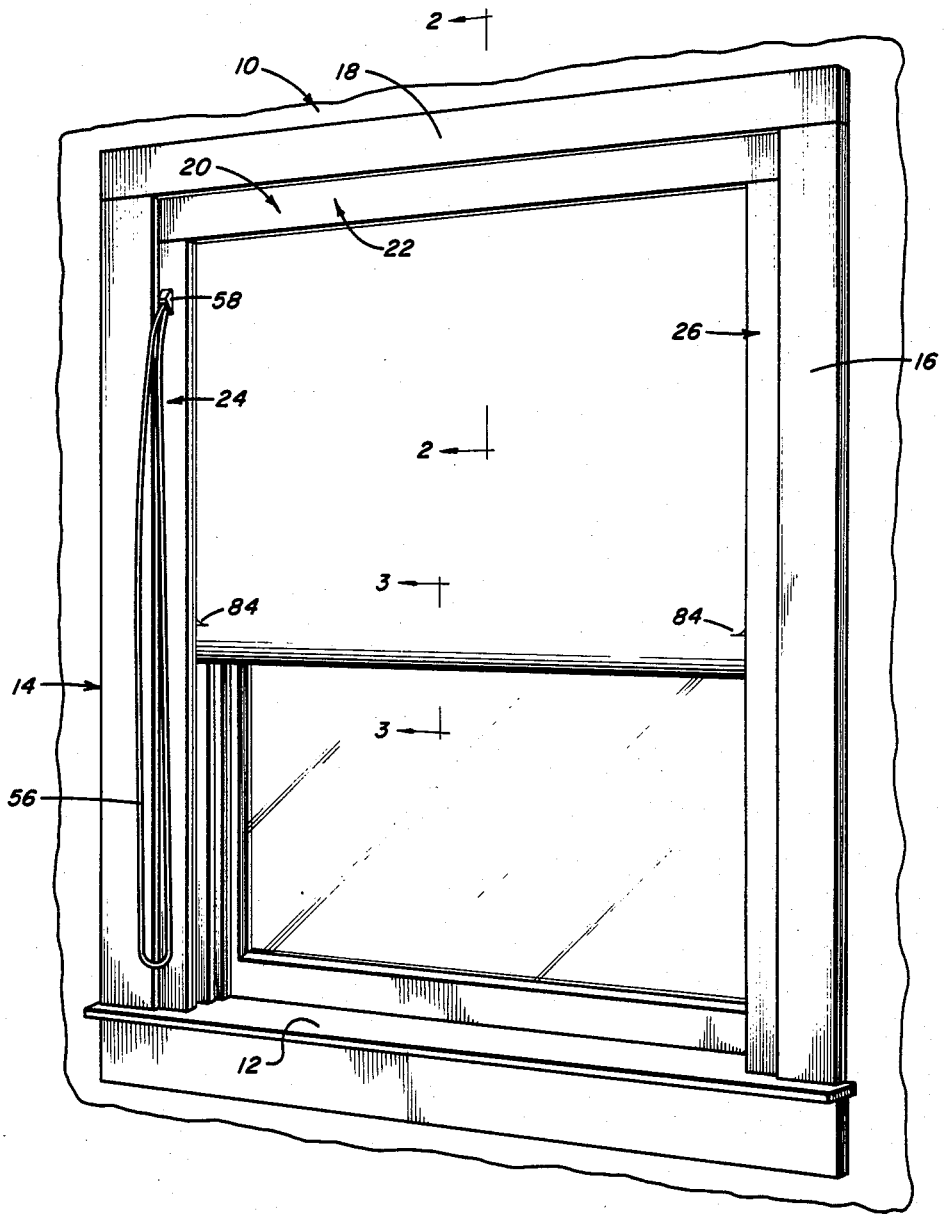
FIG. 1 is a perspective view of a window seen from the inside, on which the insulating shade assembly of the present invention is installed.

The insulating shade assembly of the present invention is shown in FIG. 1 installed within a window frame 10. The frame 10 includes a sill 12, left and right jambs 14 and 16 and a lintel 18. The window itself may be a conventional double hung window or be of any other form. The window configuration per se is not part of the present invention.

The insulating shade assembly 20 is mounted within the window frame 10 by means of a top U-shaped channel 22 secured to the bottom surface of lintel 18, and left and right side U-shaped channels 24 and 26 secured to the facing surfaces of the jambs 14 and 16. While the channels 22, 24 and 26 are shown mounted within the window or frame, it is to be understood that they may be mounted on the front faces of the lintel and jambs so as to project into the dwelling or other building in which the shade is installed. The three channels make up the frame of the shade assembly.

Figure 2:
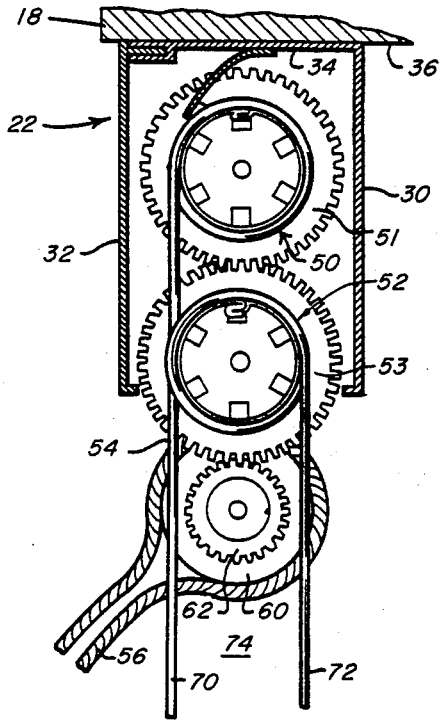
FIG. 2 is a fragmentary cross-sectional view of the shade assembly, taken along the section line 2—2 in FIG. 1.

The insulating shade assembly 20 includes a double roller mechanism that supports the shade material. This arrangement is shown in FIG. 2. The details of the shade roller mechanism do not per se form part of the invention. The mechanism is disclosed in detail in copending application Ser. No. 339,334 filed Jan. 15, 1982 entitled "Insulating Window Covering" and having a common assignee with the present application.

Top channel 22 shown in detail in FIG. 2 includes back and front vertical flanges 30 and 32 and top wall 34. For reference, the back flange 30 is adjacent the window being insulated. Top wall 34 is secured to the bottom surface 36 of lintel 18 by screws or other convenient fasteners (not shown). The side channels 24 and 26 which are mirror images of one another include back and front flanges 96 and 98 and outside walls 94 that are secured to the facing surfaces of jambs 14 and 16.

The roller mechanism, which is supported in the top channel 22 and the upper ends of the side channels 24 and 26, includes an upper roller 50 and a lower roller 52 that may be identical. Flexible insulating shade 54 is wound clockwise about the upper roller 50 and counterclockwise about the lower roller 52, and the two rollers are geared together by gears 51 and 53 to rotate in opposite directions at the same speed so as to either simultaneously take up or play out the shade 54 wound about them.

The shade 54 is raised and lowered by means of a chord 56 which extends through an opening 58 near the top of the channel 24 (see FIG. 1) and which engages pully 60 anchored to gear 62 that in turn engages gear 53 attached to roller 52, and it in turn engages gear 51 secured to the upper roller 50. The details of this mechanism are shown and described fully in application Ser. No. 339,334, supra.

As shown in FIG. 2, the shade 54 defines inner and outer panels 70 and 72 that extend downwardly from the upper and lower rollers 50 and 52, respectively, and the two panels 70 and 72 are spaced apart to form an insulating air space 74. The lower ends of panels 70 and 72 define a U-shaped pocket 76 that carries a generally rectangular foam block 78 that extends the full width of the panels 70 and 72 into the side channels 24 and 26. Above the foam block 78 is an idler roller 80 whose diameter is slightly larger than the width of block 78 as is clearly evident in FIG. 3. The idler roller 80 is the same length as the block 78 and therefore also extends into the channels 24 and 26. The foam block 78 which is flexible will form a seal against sill 12 when the shade is fully lowered. The flexible character of the block allows the seal to be formed against the sill even when irregularities are present in the sill surface. The idler diameter is only slightly less than the internal width of the side channels 24 and 26 so that it cannot sway back and forth in the shade frame.

Figure 3:
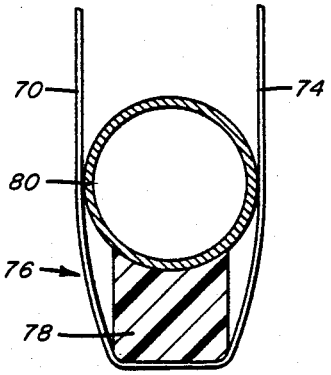
FIG. 3 is a fragmentary cross-sectional view of the bottom portion of the shade assembly taken on section line 3—3 of FIG. 1.
Figure 3A:
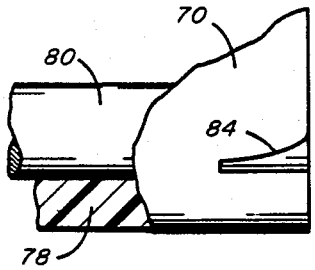
FIG. 3A is a fragmentary front elevation view of the lower corner of the shade assembly.

In FIG. 3 it will be noted that the shade material of panels 70 and 72 is spaced slightly from the block 78 because of the larger diameter of the roller 80. Where the material of the shade is spaced from the block, just beneath the point of tangency between the material and the roller, slots 84 are formed along each side edge of panels 70 and 72, which slots cooperate with the rerailing mechanism described in detail below and shown in FIGS. 4 and 7–10.

It is evident that for the shades to perform as an effective insulating cover for the windows, the edges of the shade panels 70 and 72 must be sealed within the channels 24 and 26. For that purpose, edge seal assemblies are provided in each channel, to engage the vertical side edges of panels 70 and 72.

Figure 4:
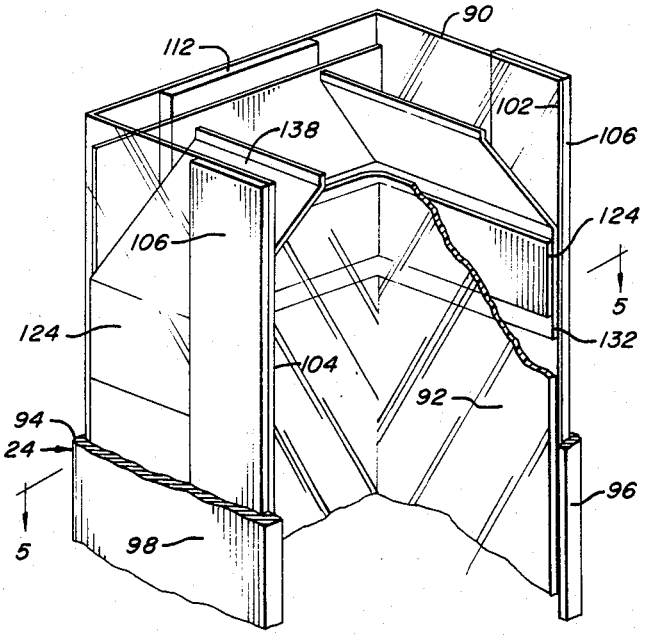
FIG. 4 is a fragmentary perspective view of the left side channel of the shade assembly and showing the edge seal and rerailer within it.
Figure 5:
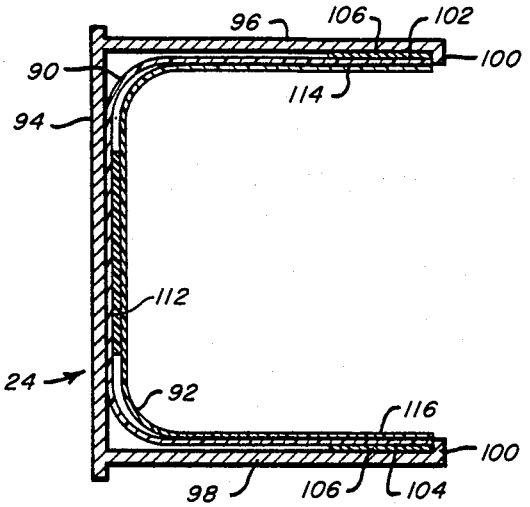
FIG. 5 is a cross-sectional view of the channel of the frame and the edge seal, taken along section line 5—5 of FIG. 4.
Figure 6:
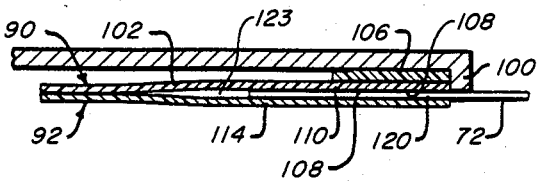
FIG. 6 is an enlarged fragmentary cross-sectional view of a portion of the edge seal and channel and showing the edge of one panel of the shade in the sealing position.

In FIGS. 4–6, the edge seals are shown in detail. The edge seals are made up of outer and inner film sheets 90 and 92 disposed within the channels. The edge seals are identical in each channel 24 and 26, and consequently only the edge seal in channel 24 will be described. In FIGS. 4 and 5, the outer wall 94 and outer and inner flanges 96 and 98 of channel 24 are shown. The outer flange 96 is the flange nearer to the window. The free ends of flanges 96 and 98 are provided with lips 100 which extend very slightly toward one another.

Each of the sheets 90 and 92 preferably is made of a UV stabilized polyester film of high clarity, and the outer sheet 90 is approximately 7 mils in thickness, while the inner sheet 92 is of 5 mils thickness. Outer sheet 90 which is normally of flat configuration, is sufficiently flexible so that it may be curved into a U-shaped configuration so as to sit within channel 24. A one-half inch wide tape strip 106 having adhesive inner and outer surfaces with a flexible foam core is secured to the outer faces of sheet 90 along its vertical edges 102 and 104, and the strips 106 are designed to adhere to the inner surfaces of the flanges 96 and 98 to hold the outer sheet 90 in position in the channel. The sheet 90 extends from substantially the bottom of the channel to a point slightly below the lower roller 52. In FIG. 6 the strip 106 is shown to support the inner surface 108 of the side 110 of sheet 90 coplanar with or slightly inside the inner edges of the lip 100 so that a wide bearing surface is exposed for the edge of the shade panel as will become clear below.

Figure 7:
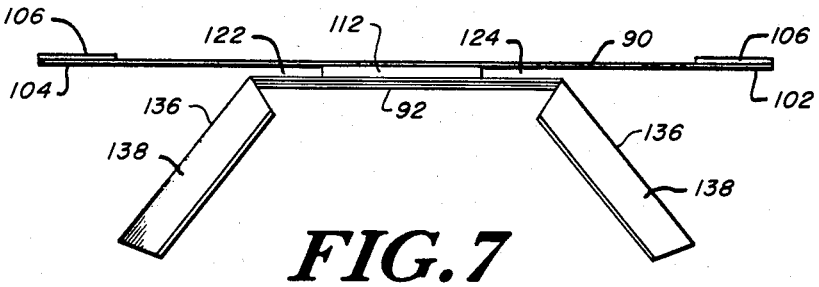
FIG. 7 is a top plan view of the rerailer and edge seal before installation in the channel.

The inner sheet 92 is substantially the same shape and size as the sheet 90, but it carries a one inch wide tape strip 112 of the same material as strips 106 with both sides bearing adhesive material so as to adhere the center of the inner sheet 92 to the center of the outer sheet 90 as is clearly shown in FIGS. 4, 5 and 7. The sides 114 and 116 of the inner sheet 92 bear against the inner surfaces of the sides 102 and 104 of the outer sheet, but the sides are not adhered together but rather are separable to form slits which receive the margins of the panels 70 and 72 of the shade. As described above, the sheets 90 and 92 are of a flexible polyester film and they possess sufficient springiness so as to bear against one another and bear against the edges of the panels of the shade 54 to form a seal about the margins. In FIG. 6, it will be noted that the edge 120 of outside panel 72 extends into the slit 123 formed between the sides 102 and 114 of the outer and inner sheets 90 and 92. The adjacent edge (not shown) of panel 70 of shade 54 fits in the slit defined between the sides 104 and 116 of the outer and inner sheets 90 and 92, respectively. Thus, both side edges of each sheet 70 and 72 is captured within the slit so as to form an effective insulating seal for the window shade assembly.

In order to automatically reinsert the edges of the panels 70 and 72 into the slits should they become dislodged for any reason and lie inside the inner sheet 92, a rerailer assembly is provided at the top of each edge seal. The rerailer assemblies are identical in each channel 24 and 26, and therefore, once again, only one will be described. In FIGS. 4, 6, 7, 7A and 7B, the rerailer is shown in detail, and in FIGS. 8–10, the manner in which the rerailer functions is illustrated.

Figure 7A:
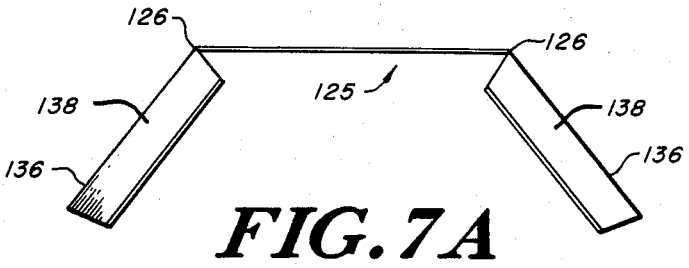
FIG. 7A is a top view of the preformed rerailer.
Figure 7B:
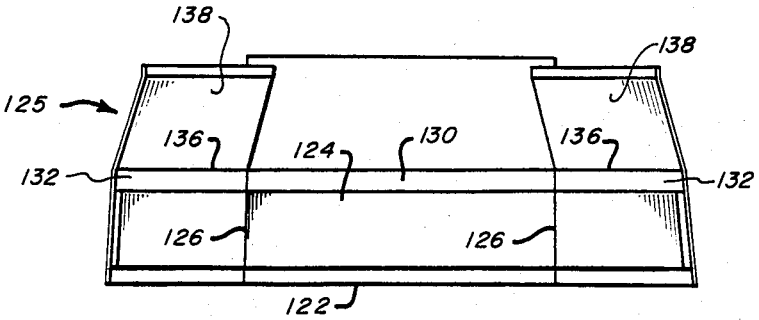
FIG. 7B is a front elevation view of the rerailer shown in FIG. 7A with the mounting tape attached and before installation on the edge seal.

The rerailer is formed of a UV stabilized polyester film stock 125 which is substantially heavier than the film of the sheets 90 and 92. Fourteen mil stock is preferred. The thickness of the rerailer stock is sufficient to enable it to be folded into shape, and it possesses sufficient springiness so as to return to the folded position when not subjected to outside forces. The rerailer blank is formed of a piece of generally U-shaped stock as shown in FIGS. 7A and 7B with the base 122 of the U being approximately $\frac{3}{4}$ inch wide and the upstanding arms being approximately $\frac{3}{4}$ inch in length. The base 122 on its inner surface carries a strip of double backed tape 124 which may be identical to the tape 106 on the sides of the outer sheet 90, and the tape 124 is used to adhere the base 122 along the top of the outer surface of the inner sheet 92 as shown in FIGS. 4 and 7. The stock 125 is folded inwardly along vertical fold lines 126 so as to conform the shape of the base 122 substantially to the inside of the channel 24 in which it is mounted. Thus, the central portion 130 of the base is approximately two inches in width, while the sides 132 are approximately $1\frac{3}{8}$ inches wide, very slightly narrower than the width of the flanges 96 and 98 of the channel 24. The upper arms of the sides of the stock are folded inwardly along horizontal fold lines 136 so that the arms form guides 138 when the rerailer is mounted in place outside the inner sheet 92 and inside the outer sheet 90. The guides 138 extend upwardly and inwardly toward one another at approximately 45° angles to the vertical when the rerailer is assembled in place in the edge seal.

The rerailer before installation in the edge seal is shaped as shown in FIGS. 7A and 7B, and when applied to the outside surface of inner edge seal sheet 92 is shaped as shown in FIG. 7. When the edge seal with the rerailer is mounted in the channel, the top portion of the edge seal with the rerailer folds sharply along lines 126 so that the rerailer has a box-like shape. Below the rerailer, however, the sheets 90 and 92 of the rerailer take a more rounded configuration as shown in FIG. 5.

Figure 8:
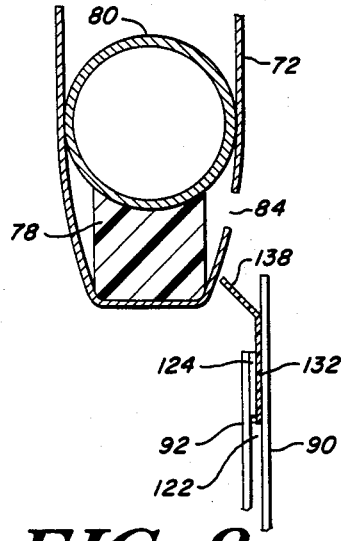
FIGS. 8–10 are fragmentary cross-sectional views of the edge seal, rerailer and shade showing how the rerailer functions to introduce the edges of the shade material into the edge seal.
Figure 9:
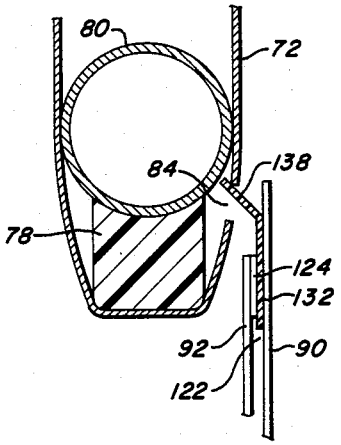
Figure 10:
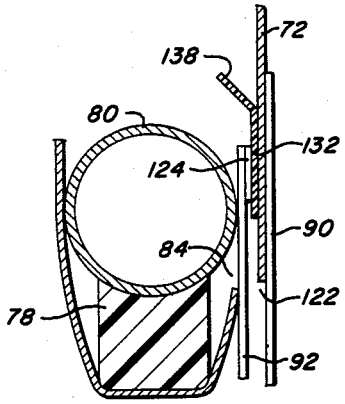

In FIGS. 8–10, the manner in which the rerailer cooperates with the slots 84 in the margins of the panels 70 and 72 of the shade is illustrated. In FIG. 8 the slot 84 in the margin of panel 72 is shown disposed adjacent the interface of the foam block 78 and idler roller 80, and the guide 138 is shown disposed beneath the slot 84. The shade is in its elevated position so that the roller 80 lies just beneath the lower roller 52 of the shade roller mechanism shown in FIG. 2. When the shade is lowered from the top position to the position shown in FIG. 9, the guide 138 enters the slot 84 and peals the shade 72 at its margin off roller 80 and moves behind the margin. As the shade is lowered further, the margin of shade 72 passes over the side 132 of the rerailer so as to lie in the slit 123 between the outer and inner sheets 90 and 92 of the edge seal. The same action occurs on the adjacent edge of panel 70, and the same action also occurs with the rerailer and edge seal in the other channel 26 of the assembly. It will be appreciated therefore that should the edges of the shade panels be dislodged from the slits 123 of the edge seals, the operator need only raise the shade to its elevated position within the frame and thereafter lower the shade, and the guides 138 will pick up the margins of the panels above the slots 84 and direct them into the slits 123.

Figure 11:
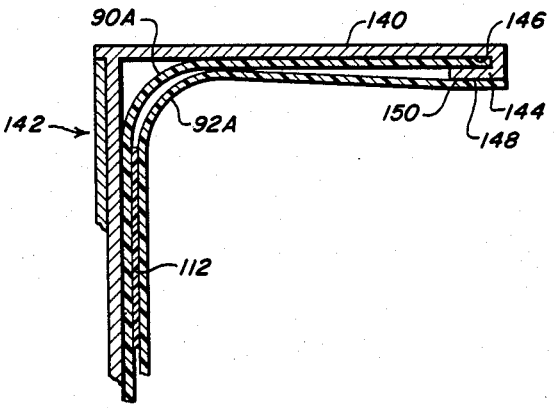
FIG. 11 is a fragmentary cross-sectional view of another embodiment of channel and edge seal.

In FIG. 11, a slightly different configuration of edge seal is shown. In that embodiment, the flanges 140 of the channel 142 have outwardly turned lips 144 that define slots 146 which may be used to hold the edge seal outer sheet 90A in place without the double adhesive strip 106. The inwardly turned lip 144 provides a surface 148 approximately one-half inch or more in width so that there is sufficient contacting surface presented to the margin of the shade panels to form an effective insulating seal. The inner sheet 92A, rather than bearing against the margins of the outer sheet 90A, bear against the inner surfaces 148 of the lips 144, and the contacting surfaces of the sides of the inner sheet 92A and the lips 144 define the slits 150 to receive the margins of the panels of shade 54. As in the previous embodiment, the one inch wide strip of double adhesive foam 112 is employed to connect the inner sheet 92A to the outer sheet 90A.

While in the embodiments shown and described adhesive foam strips are employed to connect the centers of the inner and outer sheets of the edge seal together, it will be appreciated that the two sheets may be ultrasonically welded along their centers at selected spots to perform the same function. The spaced ultrasonic welds joining the sheets allow the sheets to be cut and the derailers to be slipped between them when the material is fabricated.

While in the two embodiments of edge seal shown both inner and outer sheets are used to form the seal, it will be appreciated that in the embodiment of FIG. 11 the outer sheet principally performs the function of retaining the edges of the panels within the channel. The seal is actually formed at least in part between the inner sheet and the in-turned lip 144 of the channel.

It will be appreciated that the edge seals and rerailers of this invention may be manufactured very inexpensively, and they are very easy to install within the shade side channels. If the edge seals are made of transparent material, even those parts not actually hidden by the shade will be hardly visible within the channels. Yet wide contacting surfaces are provided between the sheets of the edge seal and the margins of the shade panels to form a very effective weather tight seal about the shade.

From the foregoing description it will be appreciated that numerous modifications may be made of this invention without departing from its spirit. Therefore, it is not intended to limit the scope of this invention to the two embodiments illustrated and described. Rather the scope is to be determined by the appended claims and their equivalents.

What is claimed is:

1. An insulating window shade assembly adapted to be mounted on the inside of a window comprising a shade frame having a pair of opposed vertical side channels open in a direction facing one another and adapted to be mounted on the inside of the window, each channel having a back wall and inner and outer flanges, a flexible insulating shade having its ends secured at the top of the shade frame and with its intermediate portion extending downwardly between the side channels to form a pair of spaced apart and parallel insulating shade panels, the bottom of the intermediate portion forming a U-shaped fold in the shade, means disposed within the U-shaped fold weighing the bottom of the shade to cause the panels to lie in vertical planes, and two pair of generally parallel inner and outer, spring-like vertically extending, elongated sheets together formed into two U-shaped edge seals, one edge seal lying within each of the channels, the base of each U-shaped edge seal being disposed adjacent the back wall of the channel and the sides of the U-shaped edge seal being disposed within the channel adjacent the channel flanges, the adjacent sides of the sheets defining slits within the channels just inside the flanges, and the vertical side edges of the panels extending into the slits to form surface to surface edge seals with the sheets.

2. An insulating window shade assembly as defined in claim 1 further characterized by rerailing means disposed in the side channels adjacent the tops of the elongated sheets for guiding the edges of the panels into the slits.

3. An insulating window shade assembly as defined in claim 2 further characterized by said rerailing means including upwardly and inwardly extending guides at the tops of the sides of the inner sheet of the edge seal, and slots cut into the edges of the panels for receiving the guides when the shade is lowered from the top of the shade frame.

4. An insulating window shade assembly as defined in claim 3 further characterized by said sheets being made of plastic film material and with the outer sheet of each edge seal lining its respective channel.

5. An insulating window shade assembly as defined in claim 4 further characterized by said plastic material being UV stabilized polyester film.

6. An insulating window shade assembly as defined in claim 3 further characterized by said means disposed within the U-shaped fold of the shade including a strip of sponge-like material being disposed within the U at the bottom of the fold and a rigid bar disposed in the U above the strip.

7. An insulating window shade assembly as defined in claim 6 further characterized by the ends of the bar extending into the channels.

8. An insulating window shade assembly as defined in claim 7 further characterized by said bar having a greater width than the strip, and the slots in the edges of the panels being at the interface of the strips and bars.

9. An insulating window shade assembly adapted to be mounted on the inside of a window comprising a shade frame having a pair of opposed vertical side channels open in a direction facing one another and adapted to be mounted on the inside of the window, said channels having a pair of parallel side flanges and a back wall connecting the outside edges of the flanges together, a pair of parallel, closely spaced, horizontal rollers at the top of the shade frame, flexible insulating shade panels having their tops connected to the respective rollers and suspended downwardly in spaced apart relationship off the rollers, the bottoms of the panels being connected together and being weighted to cause the panels to lie in vertical planes, and an edge seal disposed in each side channel, each edge seal including an outer flexible sheet disposed in and lining its respective channel and having sides lying within the side flanges of the channel, and an inner flexible U-shaped sheet secured along its center to the outer flexible sheet with the sides of inner sheet lying against the inner surfaces of the sides of the outside sheet, the side edges of the panels lying between the facing surfaces of the inner and outer sheets to form seals about the edges of the panels.

10. A shade assembly as defined in claim 9 further characterized by rerailer means secured to the top of the inner sheet and disposed between the inner and outer sheets, said rerailer including a pair of guides extending upwardly and inwardly from the top of each side of the inner sheet, and slots in the panels adjacent their bottoms on each side thereof adapted to span the guides so that the guides can engage the upper margin of each slot to guide the side edges of the panels above the slots between the sides of the inner and outer sheets.

11. An insulating window shade assembly adapted to be mounted on the inside of a window comprising a shade frame having a pair of opposed vertical side channels open in a direction facing one another and adapted to be mounted on the inside of the window, each channel having inner and outer flanges, a flexible insulating shade having its ends secured at the top of the shade frame and having spaced apart and parallel insulating shade panels extending downwardly between the side channels, the bottom of the panels being connected together, means disposed at the bottoms of the panels weighing down the bottom of the shade to cause the panels to lie in vertical planes, and two pair of generally parallel inner and outer, spring-like vertically extending, elongated sheets, one pair of said sheets lying within each of the channels, each pair of sheets having a generally U-shape to conform to the shape of said channel, and having outer edges facing said panels to form U-shaped edge seals, the edges of the two sheets of each pair being disposed within the channels adjacent the channel flanges, the adjacent sides of the edges of each pair of the sheets being biased against one another and defining slits within the channels just inside the flanges, the vertical side edges of the panel extending into the slits to be captured between the two edges of the two sheets to form surface to surface edge seals with the sheets.

12. An insulating window shade assembly as defined in claim 11 further characterized by rerailing means disposed in the side channels adjacent the tops of the elongated sheets for guiding the edges of the panels into the slits.

13. An insulating window shade assembly adapted to be mounted on the inside of a window comprising a shade frame having a pair of opposed vertical side channels open in a direction facing one another and adapted to be mounted on the inside of the window, each channel having inner and outer flanges, a flexible insulating shade having its ends secured at the top of the shade frame and having spaced apart and parallel insulating shade panels extending downwardly between the side channels, means disposed at the bottom of the panels weighing down the bottom of the shade to cause the panels to lie in vertical planes, two pair of spring-like vertically extending, elongated sheets, each pair of sheets having a generally U-shape to conform to the shape of said channels and having outer edges facing said panels to form U-shaped edge seals, one edge seal lying within each of the channels, the edges of the two sheets of each pair being disposed within the channels adjacent the channel flanges and defining slits within the channels just inside the flanges, the vertical side edges of the panels extending into the slits to be captured between the two edges of the two sheets to form surface to surface edge seals with the sheets, rerailing means disposed in the side channels adjacent the tops of the elongated sheets for guiding the edges of the panels into the slits, said rerailing means including upwardly and inwardly extending guides at the tops of the sides of the inner sheet of the edge seal, and slots cut into the edges of the panels for receiving the guides when the shade is lowered from the top of the shade frame.

* * * * *